US009599439B1

(12) United States Patent
Sylvester

(10) Patent No.: US 9,599,439 B1
(45) Date of Patent: Mar. 21, 2017

(54) COMBINATION RIBBED RAIL MOUNT WITH KEYHOLE OR SLOTTED RAIL MOUNT

(71) Applicant: Primary Weapons, Boise, ID (US)

(72) Inventor: Dean Sylvester, Boise, ID (US)

(73) Assignee: Primary Weapons, Boise, ID (US)

( * ) Notice: Subject to any disclaimer, the term of this patent is extended or adjusted under 35 U.S.C. 154(b) by 0 days.

(21) Appl. No.: 15/003,343

(22) Filed: Jan. 21, 2016

Related U.S. Application Data

(60) Provisional application No. 62/106,163, filed on Jan. 21, 2015.

(51) Int. Cl.
*F41G 11/00* (2006.01)

(52) U.S. Cl.
CPC ..... *F41G 11/003* (2013.01)

(58) Field of Classification Search
CPC ..... F41C 27/00; F41C 23/16; F41G 11/003; F41G 11/004; F41G 11/002
USPC ..... 42/72, 85, 90, 124
See application file for complete search history.

(56) References Cited

U.S. PATENT DOCUMENTS 7,216,451 B1 5/2007 Troy
7,793,452 B1 * 9/2010 Samson ..... F41C 23/16 42/71.01
8,028,459 B2 * 10/2011 Williams ..... F41G 11/003 42/106
8,028,460 B2 * 10/2011 Williams ..... F41G 11/003 42/84
D674,860 S 1/2013 Deros
D737,397 S * 8/2015 Cheng ..... D22/108
D747,426 S * 1/2016 Cheng ..... D22/108
9,239,210 B2 * 1/2016 Mayberry ..... F41C 23/16
D750,192 S * 2/2016 Silvers ..... D22/108
2010/0287809 A1 * 11/2010 Williams ..... F41G 11/003 42/90
2011/0214328 A1 * 9/2011 Williams ..... F41G 11/003 42/90
2012/0167434 A1 * 7/2012 Masters ..... F41C 23/16 42/90
2015/0267993 A1 * 9/2015 Cheng ..... F41C 27/00 42/90
2015/0308786 A1 * 10/2015 Cheng ..... F41G 11/001 42/90

(Continued)

OTHER PUBLICATIONS

US 8,713,840, 05/2014, Compton et al. (withdrawn)

(Continued)

*Primary Examiner* — Benjamin P Lee
(74) *Attorney, Agent, or Firm* — Schacht Law Office, Inc.; Dwayne Rogge

(57) ABSTRACT

Disclosed herein is an attachment system for a firearm. One example of the attachment system comprising: a ribbed rail comprising; an upper surface lying in a first plane, a plurality of laterally extending rail ribs projecting transversely from the upper surface; the longitudinally adjacent rail ribs forming recoil grooves therebetween, a keyhole rail comprising; a laterally extending substantially cylindrical surface forming part of a keyhole void through the ribbed rail; a plurality of substantially planar, laterally and longitudinally extending side surfaces forming part of the keyhole void through the ribbed rail, and a laterally extending end surface extending between the side surfaces.

6 Claims, 3 Drawing Sheets

(56) References Cited

U.S. PATENT DOCUMENTS

2015/0316354 A1* 11/2015 Cheng ..... F41G 11/001 42/90

OTHER PUBLICATIONS ar15news.com, New Mk3 CBR (Carbine Battle Rifle), http://www.ar15news.com/category/manufacturers/cmmg/, Nov. 3, 2014, 6 pages.

Max Slowik, guns.com, New Open-Source KeyMod Universal Mounting System by Vltor, http://www.guns.com/2012/07/27/vltor-keymod-open-source-universal-mounting-system/, Jul. 27, 2012, 6 pages.

Tacticarolina, War of the Rails, http://tacticarolina.com/tag/m-lok/, Nov. 26, 2014, 5 pages.

United States Department of Defense, Military Standard, Dimensioning of Accessory Mounting Rail for Small Arms Weapons, Feb. 3, 1995, 11 pages.

Wikipedia, KeyMod, http://en.wikipedia.org/wiki/keyMod?oldid=634841732, Nov. 24, 2014, 4 pages.

Wikipedia, Picatinny rail, http://en.wikipedia.org/wiki/Picatinny%20rail?oldid=631120809, Nov. 21, 2014, 3 pages.

* cited by examiner

COMBINATION RIBBED RAIL MOUNT WITH KEYHOLE OR SLOTTED RAIL MOUNT

RELATED APPLICATIONS

This application claims priority benefit of U.S. Provisional Ser. No. 62/106,163, filed Jan. 21, 2015, incorporated herein by reference.

BACKGROUND OF THE DISCLOSURE

Field of the Disclosure

This application relates to the field of mounting systems on a firearm allowing removable attachment of accessories.

BRIEF SUMMARY OF THE DISCLOSURE

Disclosed herein is an attachment system for a firearm. One example of the attachment system comprising: a ribbed rail comprising; an upper surface lying in a first plane, a plurality of laterally extending rail ribs projecting transversely from the upper surface; the longitudinally adjacent rail ribs forming recoil grooves there between, a keyhole rail comprising; a laterally extending substantially cylindrical surface forming part of a keyhole void through the ribbed rail; a plurality of substantially planar, laterally and longitudinally extending side surfaces forming part of the keyhole void through the ribbed rail, and a laterally extending end surface extending between the side surfaces.

The attachment system as recited above may be arranged wherein the laterally extending substantially cylindrical surface has a lateral axis centered upon a longitudinal centerline of one of the recoil grooves.

The attachment system as recited above may be arranged wherein the side surfaces and end surface of the keyhole void has a radially extending rabbet on a transversely lower edge thereof.

The attachment system as recited above may be arranged wherein the end surface is substantially cylindrical.

DETAILED DESCRIPTION OF THE DISCLOSURE

Disclosed herein is a mounting system combining a MIL-STD-1913 Rail Mount with a keyhole or slotted rail mount in a novel way so as to maintain structural integrity and allow mounting of attachments of each spec. without compromising mounting stability.

An axes system 10 is utilized in this disclosure to aid in description. The axes system 10 includes a lateral axis 12, a longitudinal axis 14, and a transverse axis 16.

Figure 1:
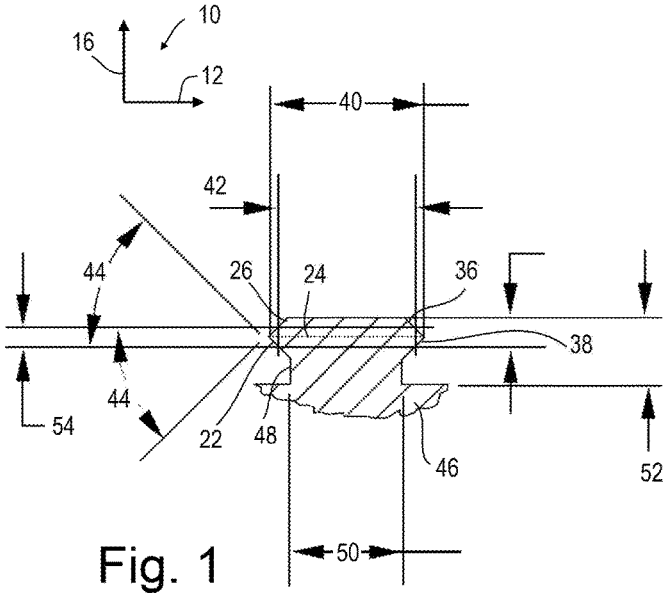
Fig. 1 Prior Art
FIG. 1 is an end cutaway view of a prior art MIL-STD-1913 rail mount.
Figure 2:
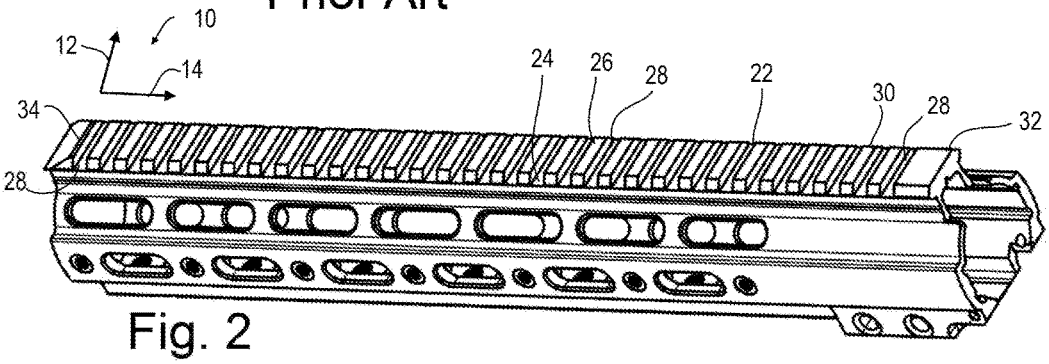
Fig. 2 Prior Art
FIG. 2 is an isometric view of a firearm hand guard having a prior art MIL-STD-1913 rail mount thereon.

The MIL-STD-1913 standard for tactical rail mounts for firearms has been approved by the US military since February 1995 and used with much success. One such example of a prior art rail 22 conforming to the MIL-STD-1913 standard is shown in FIG. 1 and FIG. 2. The rail 22 having an upper surface 24 with a plurality of rail ribs 26 extending transversely 12 from the upper surface 24. Between adjacent or facing rail ribs 26 is provided a recoil groove 28 as shown in the example hand guard 30 shown in FIG. 2. Also, where end projections 32 and 34 are provided, recoil grooves 28 are formed between longitudinally facing surfaces of the end projections.

The MIL-STD-1913 rail mount is a standard for a mounting rail used with small arms weapons systems. The rail mount standard establishes uniform accessory mounting rails and accessories that are interchangeable among manufacturers. The term accessory refers to hardware which can be attached to the accessory mounting rails for additional functionality such as laser pointers, fire control devices, night vision devices, grenade launchers, optics, thermal weapons sites, sight levels, etc.

The lateral sides of the rail 22 of the MIL-STD-1913 standard rails are wedge-shaped and project laterally outward from the upper surface 24. These wedges include an upper angled surface 36 and a lower angled surface 38. In more detail, the distance 40 between the laterally outward points of these wedges is between 0.835±0.005 inches. The lateral width 42 of each recoil groove 28 at the upper surface 24 is 0.748±0.002 inches. The angle 44 of each of the upper angled surface 36 and lower angled surface 38 to the upper surface 24 being substantially 45°. The rail 22 is offset from a base structure 46 by way of an offset projection 48 having a width 50 of 0.617±0.010 inches and a minimum transverse length 52 of 0.367 inches. The transverse thickness 54 of the rail is 0.164±0.020 inches.

The recoil grooves 28 forming a longitudinal 14 indexing system allowing for secure mounting and longitudinal positioning of an accessory to a firearm such that most impact or jarring will not affect alignment of the accessory to the firearm.

Figure 3:
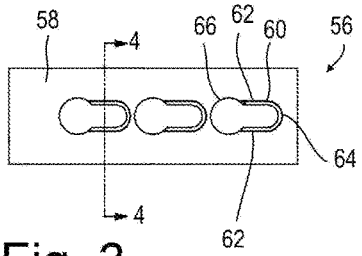
Fig. 3 Prior Art
FIG. 3 is a bottom view of one example of a keyhole or KeyMod rail mount.
Figure 4:
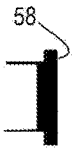
Fig. 4 Prior Art
FIG. 4 is a cutaway view taken along line 4-4 of FIG. 3

Looking to FIG. 3 is shown another accessory rail mounting system 56 standard generally known as a KeyMod system or standard. So-called due to the keyhole shaped apertures through the support surface 58 shown in FIG. 4. FIG. 3 shows the underside or transversely inward side of the support surface 58 as evidenced by the rabbets 60 around the side surfaces 62 and end surface 64. In installation, a fastener is passed through the larger diameter substantially cylindrical surface 66 extended transversely 16 through the support surface 58 and is then slid or repositioned longitudinally 14 so as to engage the rabbets 60. Said fastener(s) may then be tightened so as to securely attach an accessory to the support surface 58.

The KeyMod system shown in FIG. 1-4 is designed to overcome specific detriments of the MIL-STD-1913 standard defined above. The KeyMod system is designed to eliminate the need for the perceived heavy and often non-ergonomic MIL-STD-1913 accessory rails. The KeyMod system consists of two parts: the KeyMod hole and the KeyMod slot. The slot is distinctive with a larger diameter through hole (cylindrical surface 66) combined with a narrow slot region formed by the side surfaces 62. The slot is chamfered or rabbeted 60 on the backside while the through hole 66 may be sized for clearance of an accessory such as for example a quick-detach sling swivel.

Figure 5:
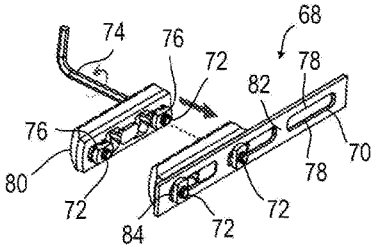
FIG. 5 is a bottom isometric view of a slotted or MLOK rail mount.

Looking to FIG. 5 is shown yet another rail attachment system 68. This attachment system 68 is a slotted or negative space attachment system and often goes by the name M-LOK. The M-LOK system 68 addresses perceived negatives of each of the MIL-STD-1913 system, and the KeyMod system. The M-LOK system is designed for ease in manufacturing as it has simpler surfaces than the MIL-STD-1913. In addition, the M-LOK system is also specifically designed to utilize polymer manufacturing, rather than the metal machining manufacturing process generally required for the tolerances and surfaces required of an MIL-STD-1913 or KeyMod system. The M-LOK system is generally designed as a negative space attachment system utilizing slots 70 through which fasteners 72 are passed. A tool 74, such as an Allen key, screwdriver, socket wrench, nut driver, etc. is rotated so as to rotate the wings 76 against the longitudinal sides 78 of each slot 70.

As shown in FIG. 5, the accessory 80 attached thereto is a short section of MIL-STD-1913 rail. This attachment of a secondary rail system is especially useful when the slotted system 68 is formed in the handguard, or other portion of the firearm made of a polymer material where a metallic attachment system is required.

The fasteners 72 may include a cammed T-nut 84 for easy attachment and, for structural enhancement, bridges 82 may be formed separating the slots 70.

Generally, the M-LOK system utilizes an attachment assembly including a cammed T-nut 84 that positions the accessory consistently for installation and removal. To attach, the gap between each T-nut and the accessory is adjusted specific to the thickness of the mounting surface, the T-nuts are aligned with the slot 70, and the T-nuts are inserted in the desired location. An additional quarter (¼) to half (½) turn of each screw for each T-not rotates each T-nut to the orientation shown in the right side of FIG. 5.

Figure 6:
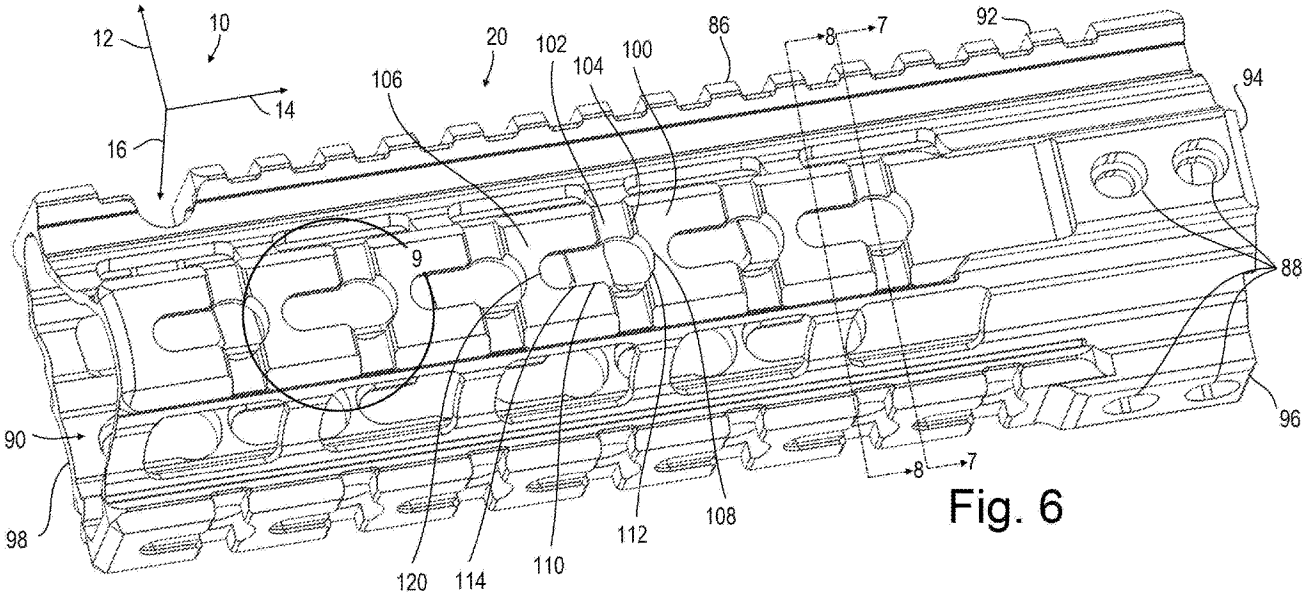
FIG. 6 is an isometric view of a handguard with multiple segments of the Combination MIL-STD-1913 Rail Mount with Keyhole thereon.

In FIG. 6 is shown a hand guard 86 utilizing the disclosed Combination Ribbed Rail Mount with Keyhole or Slotted Rail Mount. Such components are generally attached to the upper or lower receiver of a tactical style rifle by way of a firearm attachment voids 88 such that the barrel of the firearm passes through the barrel opening 90. Such hand guards are very useful to mitigate shock impact passed from the firearm to the user, provide a safe and relatively comfortable grasping surface, and also to reduce heat transfer between the barrel of the firearm and the user's hands. Such hand guards 86 provide a very secure way to grasp the firearm during a tactical situation wherein the firearm may be rotated about the axis of the barrel or fired in nontraditional orientations as well as be carried in a ready position.

The example shown in FIG. 6 comprises four attachment sides, three of these sides use the disclosed combined ribbed (MIL-STD-1913) rail mount with keyhole or slotted rail mount while one side (the first side 92) only uses a ribbed (MIL-STD-1913) rail mount. In the example of FIG. 6, the first attachment side 92 utilizes a ribbed rail mount while the second attachment side 94, third attachment side 96, and fourth attachment side 98 utilize the disclosed Combination Ribbed Rail Mount with Keyhole or Slotted Rail Mount 20.

It can be seen how the ribbed portion 106 of the rail mount comprises a plurality of laterally 12 extending rail ribs 100 extending transversely from the upper surface 102. These ribs 100 forming recoil grooves 104 functionally equivalent to the rail channels 28 of the MIL-STD-1913. These ribs 100 will allow mounting of accessories designed for attachment to MIL-STD-1930 rails. In the example shown, it can be seen that the rail ribs 100 of the Combination Ribbed Rail Mount with Keyhole or Slotted Rail Mount 20 shown in FIG. 6 are substantially longer (wider) in the longitudinal 14 direction than those shown in FIG. 2. These longer ribs allow for more secure mounting of an accessory to the Combination Ribbed Rail Mount with Keyhole or Slotted Rail Mount 20 mounting system.

Figure 9:
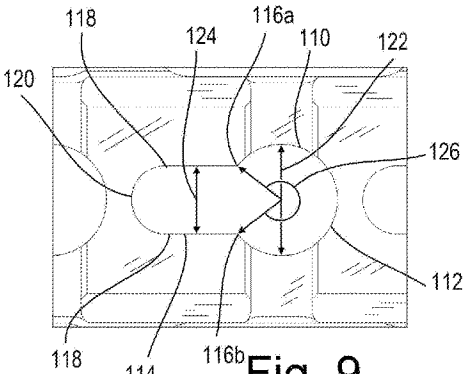
FIG. 9 is a detail view of area 9 of FIG. 6.
Figure 8:
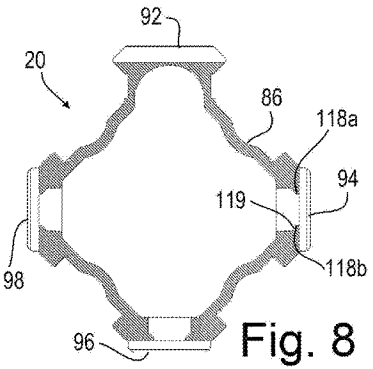
FIG. 8 is a cutaway view taken along line 8-8 of FIG. 6.
Figure 7:
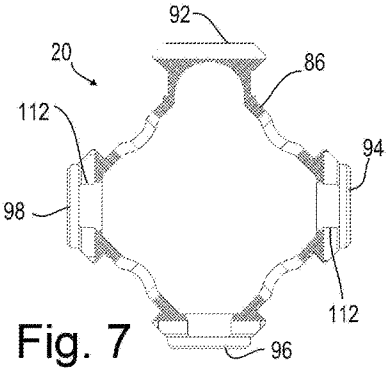
FIG. 7 is a cutaway view taken along line 7-7 of FIG. 6.

As shown, the keyhole portion 108 comprises surfaces defining a plurality of keyhole voids 110. One such keyhole void 110 is shown in detail in FIG. 9. Each keyhole void 110 of this example of the disclosed combination mounting system 20 has a substantially cylindrical portion 112 at a first longitudinal end thereof. In one example, to conform to the KeyMod standards, this substantially cylindrical portion 112 is about ⅜ of an inch in diameter 122.

The recoil grooves 104 and the channel void 114, as well as the rabbet or cutaway portion 119 extend longitudinally from the substantially cylindrical void 112. Each channel portion 114 extends longitudinally from the substantially cylindrical portion 112 and these surfaces intersect at a transition point 116 (see FIG. 9). The channel 114 formed by a plurality of substantially planar side surfaces 118 extending through the rail ribs 100 and having rabbets 119 extending laterally outward therefrom. The side surfaces 118 extending from the transition point 116 of the substantially cylindrical portion 112 longitudinally to an end surface 120. In the example shown, the end surface 120 is also substantially cylindrical although it may have other shapes. In addition, the end surface 120 also has a rabbeted edge 119 extending laterally inward and longitudinally therefrom.

As with the keyhole mounting system described above in shown in FIGS. 3 and 4, the keyhole portion 108 allows for an accessory having a flanged nut such as the cammed t-nuts 72 to be attached to the rail such that the flanged nut passes through the substantially cylindrical void 112 whereupon the accessory is slid or repositioned longitudinally such that the flanged nut engages the rabbets 119 whereupon a fastener 72 as shown in FIG. 5 may tighten the flanged (cammed t) nut 84 against the rabbets 119 holding the accessory securely in place against the rail.

In one example, as shown the substantially cylindrical portion 112 has a diameter 122 which is substantially larger than the width 124 of the channel portion 114. In addition, the angle 126 from a first transition point 116*a* around the substantially cylindrical portion 112 to the opposing transition point 116*b* is substantially greater than 180°.

In other examples, where the slotted attachment system 68 shown in FIG. 5 is combined with the ribbed rail attachment 106 or MIL-STD-1913, the substantially cylindrical void 112 may be omitted. Alternatively, adjacent keyhole voids 108 may be dimensioned to receive accessories 80 as described relevant to the slotted system 68 shown in FIG. 5 without modification to the combination shown in FIG. 6.

Figure 10:
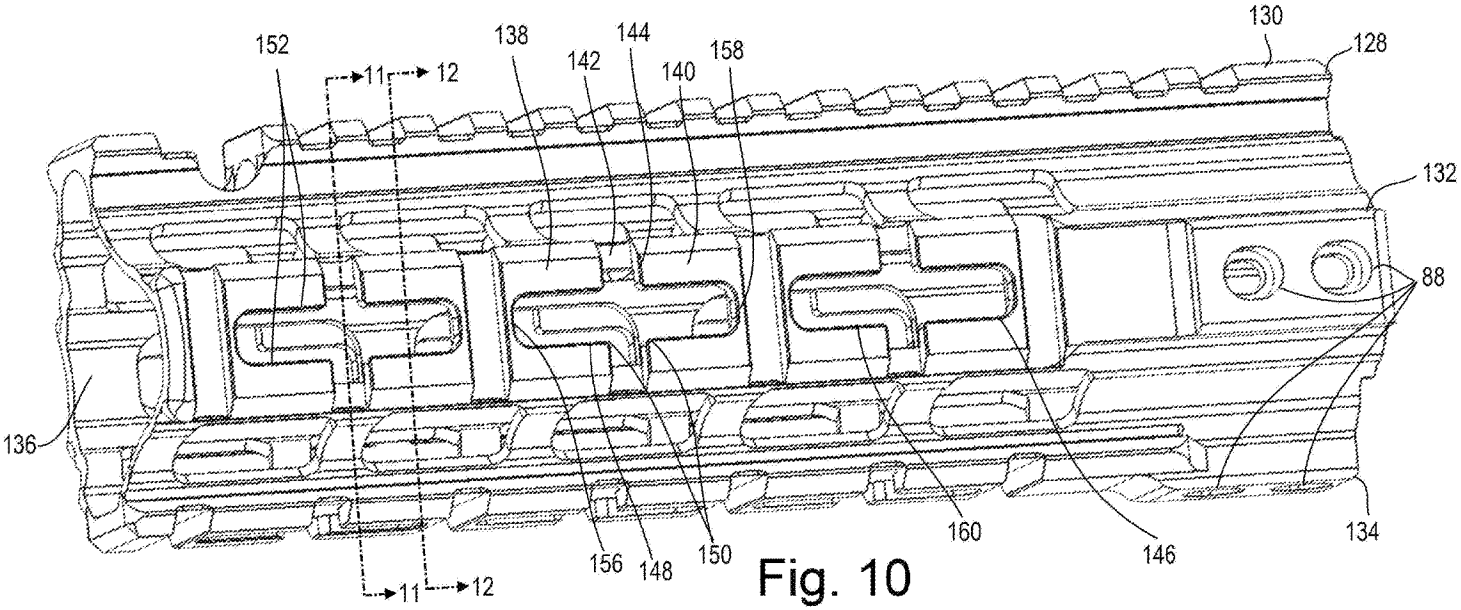
FIG. 10 is an isometric view of a handguard with multiple examples of the Combination MIL-STD-1913 Rail Mount with Slotted Rail Mount thereon.

The handguard 128 shown in FIG. 10 comprises four (4) attachment sides 130, 132, 134, 136 by way of example, three of these sides 132, 134, 136 use a combined ribbed rail mount with slotted (M-Lok) rail mount while one side (the first side 130) uses a ribbed rail mount. In the drawing, the first attachment side 130 utilizes a ribbed rail mount while the second attachment side 132, third attachment side 134, and fourth attachment side 136 utilize a combined ribbed rail mount and a slotted rail mount.

It can be seen how the ribbed portion 138 of the rail/slotted mount comprises a plurality of laterally 12 extending rail ribs 140 extending laterally across the ribbed portion 138 and extend transversely outward from the upper surface 142. This configuration forming recoil grooves 144 functionally equivalent to the rail channels 28 of the MIL-STD-1913. This arrangement will allow mounting of most if not all accessories that conform to the MIL-STD-1930 standard. In the example shown in FIG. 10, it can be seen that the rail ribs 140 of the hand guard 128 are substantially the same in the longitudinal 14 direction as those shown in the example of FIG. 2. This spacing allows for secure mounting of an accessory to the slotted mounting system.

As shown, the slotted portion 146 comprises surfaces defining a plurality of longitudinally extending slot voids 148. Each slot void 148 of this example has a slot portion extending longitudinally forward and rearward from transition points 150.

Figure 12:
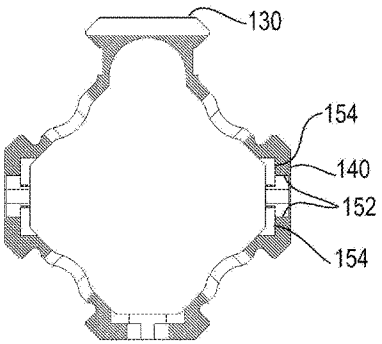
FIG. 12 is a cutaway view taken along line 12-12 of FIG. 10.
Figure 11:
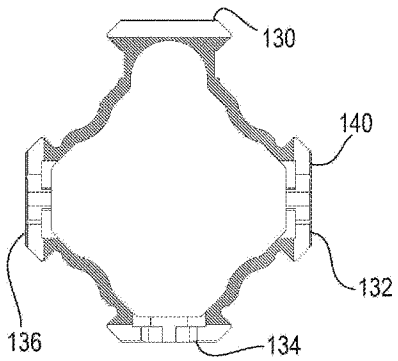
FIG. 11 is a cutaway view taken along line 11-11 of FIG. 10.

FIG. 12 shows that in one example the slot void 148 formed by a plurality of substantially planar side surfaces 152 extending through the rail ribs 140 and having optional rabbets 154 extending laterally outward therefrom. The side surfaces 152 extending from the transition points 150 longitudinally to forward 156 and rearward 158 end surfaces. In addition, the end surfaces 156/158 may also have a similar rabbeted edge extending longitudinally therefrom.

As with the keyhole mounting system described above in shown in FIGS. 3 and 4, the slotted mounting system 160 allows for an accessory having a flanged nut extending therefrom to be attached such that the flanged nut passes through the cross of the slot void 148 and the recoil groove 144 whereupon the accessory is slid or repositioned longitudinally such that the flanged nut engages the rabbets 154 whereupon a fastener as shown in FIG. 5 may tighten the flanged nut against the slotted attachment system 160 holding the apparatus securely in place.

In addition, adjacent slot voids may be spaced such that the slot voids 148 of adjacent slot voids may receive accessories 80 as described relevant to FIG. 5 without modification to the combination shown in FIG. 10.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. An attachment system for a firearm, the attachment system comprising:

a ribbed rail configured for attachment of a firearm accessory thereto, the ribbed rail comprising:
- an upper surface lying in a first plane;
- a plurality of laterally extending rail ribs projecting transversely from the upper surface;
- the longitudinally adjacent rail ribs forming recoil grooves therebetween;
- the ribbed rail further conforming to MIL-STD-1913 specifications;

a slotted mounting arrangement configured for attachment of a firearm accessory thereto, the slotted mounting formed of a keyhole slot comprising:
- a transversely and laterally extending surface forming part of a void extending vertically through the ribbed rail;
- a plurality of substantially planar, transversely and longitudinally extending side surfaces forming part of the void extending vertically through the ribbed rail;
- a laterally extending end surface extending between the side surfaces;
- wherein the laterally extending surface forming part of a void extending vertically through the ribbed rail comprises a cylindrical surface having a lateral diameter;
- wherein the plurality of substantially planar, transversely and longitudinally extending side surfaces forming part of the void extending vertically through the ribbed rail have a lateral width there between smaller than the diameter of the substantially cylindrical portion;
- wherein each side surface intersects the cylindrical surface at a transition point; and
- wherein the cylindrical surface between the transition points is greater than 180°.

2. The attachment system as recited in claim 1 wherein the cylindrical surface has a lateral axis longitudinally centered upon a longitudinal centerline of one of the recoil grooves.

3. The attachment system as recited in claim 1 wherein the side surfaces and end surface of the keyhole void has a transversely and radially extending rabbet on a transversely lower edge thereof.

4. The attachment system as recited in claim 1 wherein the end surface is substantially cylindrical.

5. The attachment system as recited in claim 1 wherein the cylindrical surface has a lateral axis longitudinally centered upon a longitudinal centerline of one of the recoil grooves.

6. The attachment system as recited in claim 1 comprising a plurality of a plurality of keyhole slots wherein the cylindrical surface of each keyhole slot has a lateral axis longitudinally centered upon a longitudinal centerline of one of the recoil grooves.

* * * * *